US009094748B2

(12) United States Patent
Akino

(10) Patent No.: US 9,094,748 B2
(45) Date of Patent: Jul. 28, 2015

(54) DYNAMIC MICROPHONE UNIT AND DYNAMIC MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/308,744

(22) Filed: Jun. 19, 2014

(65) Prior Publication Data

US 2015/0003640 A1 Jan. 1, 2015

(30) Foreign Application Priority Data

Jun. 27, 2013 (JP) ..... 2013-134482

(51) Int. Cl.

| | |
|---|---|
| ***H04R 3/02*** | (2006.01) |
| ***H04R 1/28*** | (2006.01) |
| ***H04R 9/08*** | (2006.01) |
| *H04R 1/38* | (2006.01) |

(52) U.S. Cl.

CPC ..... *H04R 3/02* (2013.01); *H04R 1/2807* (2013.01); *H04R 9/08* (2013.01); *H04R 1/38* (2013.01)

(58) Field of Classification Search

CPC ..... H04R 1/08; H04R 9/08; H04R 11/04; H04R 17/02; H04R 21/02; H04R 9/00; H04R 9/022

USPC ..... 381/355–358, 369, 396, 397

See application file for complete search history.

(56) References Cited

U.S. PATENT DOCUMENTS

| | | | | |
|---|---|---|---|---|
| 2,217,177 | A * | 10/1940 | Massa | 381/397 |
| 4,757,547 | A * | 7/1988 | Danley | 381/397 |
| 7,715,584 | B2 * | 5/2010 | Proni | 381/397 |
| 2007/0177756 | A1 * | 8/2007 | Kemmerer | 381/397 |

FOREIGN PATENT DOCUMENTS

| | | |
|---|---|---|
| JP | 07255100 | 10/1995 |
| JP | 2011228979 | 11/2011 |
| JP | 2013-55466 | 3/2013 |

* cited by examiner

*Primary Examiner* — Suhan Ni

(74) *Attorney, Agent, or Firm* — Whitham Curtis Christofferson & Cook, PC

(57) ABSTRACT

A dynamic microphone unit includes a diaphragm vibrating upon receiving acoustic waves, a voice coil fixed to the diaphragm, vibrating together with the diaphragm, a magnetic circuit generating a magnetic field in a magnetic gap in which the voice coil is disposed, a rear air chamber formed behind the magnetic circuit, wherein holes for connecting a back side space of the diaphragm with the rear air chamber are formed in a member forming the magnetic circuit in order to reduce resonance and reduce peaks developing in frequency response characteristics, achieving uniformity of directivity.

11 Claims, 5 Drawing Sheets

DYNAMIC MICROPHONE UNIT AND DYNAMIC MICROPHONE

BACKGROUND OF THE INVENTION

1. Field of the Invention

The present invention relates to a dynamic microphone unit and a dynamic microphone that can achieve reduction of resonance so as to improve directivity.

2. Description of the Related Art

An example of a conventional unidirectional dynamic microphone unit shown in FIG. 6 will first be described. In FIG. 6, the dynamic microphone unit includes a unit case 9 as a base, and is configured by installing the following members in the unit case 9.

The unit case 9 has a cylindrical shape and includes a flange 91 formed on an upper end portion thereof and protruding inward, and an outer periphery surface of a ring yoke 1 having a cylindrical shape is fitted and fixed to an inner periphery surface of the flange 91. The ring yoke 1 is made of a magnetic substance. A disk-shaped yoke 2 is fixed to the ring yoke 1 by being pushed against a step portion that is formed over the entire circumference of an inner periphery side of the ring yoke 1. The yoke 2 and the ring yoke 1 are magnetically coupled. The yoke 2 includes a plurality of holes 22 penetrating through the yoke 2 in a thickness direction, which are formed in a circumferential direction at certain intervals.

To an upper surface of the yoke 2, a disk-shaped magnet 3 is fixed in such a manner that a central axis thereof is identical to a central axis of the yoke 2. An outer diameter of the magnet 3 is defined such that each of holes 22 of the yoke 2 is only partially covered by the magnet 3. To an upper surface of the magnet 3, a disk-shaped pole piece 4 is fixed in such a manner that a central axis thereof is identical to the central axis of the magnet 3.

In an upper end of the ring yoke 1, a flange 11 is formed protruding inward, and an inner periphery surface of the flange 11 faces an outer periphery surface of the pole piece 4 across a relatively narrow gap. The gap is a cylindrical-shaped magnetic gap. The magnet 3, the yoke 2, the ring yoke 1, the magnetic gap, and the pole piece 4 form a magnetic circuit. Magnetic flux emanating from the magnet 3 passes through the magnetic circuit and returns to the magnet 3. In the magnetic gap, a magnetic field is uniformly formed in a circumferential direction.

The outer diameter of the magnet 3 is smaller than a diameter of the inner periphery surface of the ring yoke 1, and an air chamber 10 is produced between an outer periphery surface of the magnet 3 and the inner periphery surface of the ring yoke 1. The air chamber 10 communicates with a rear air chamber 15 to form part of the rear air chamber. The air chamber 10 is called a second air chamber after the rear air chamber 15.

An outer periphery edge of an upper end of the unit case 9 is formed into a dike 94, and an outer periphery edge portion of a diaphragm 5 is fixed to an inner periphery side of the dike 94. The diaphragm 5 is made of a synthetic resin or a metal film, and includes a center dome 51 and a sub-dome 52 that surrounds the center dome 51. The center dome 51 has a shape obtained by cutting out part of a spherical surface. The sub-dome has a partial-arc-shaped cross section, and is successively formed from an outer periphery edge of the center dome 51. An outer periphery edge portion of the sub-dome 52 is fixed to the unit case 9. Upon receiving acoustic waves, the diaphragm 5 can vibrate in a longitudinal direction (vertical direction in FIG. 6) by sound pressure thereof, using the outer periphery edge portion of the sub-dome 52 as a fulcrum.

To the diaphragm 5, a voice coil 6 is fixed along a circular boundary line between the center dome 51 and the sub-dome 52. The voice coil 6 is formed into a cylindrical shape by winding a thin conductive wire, and one end of the cylindrical shape is fixed to the diaphragm 5. The voice coil 6 is positioned in the magnetic gap, and separated from both of the ring yoke 1 and the pole piece 4.

On a front side of the diaphragm 5, an equalizer 8 which also serves as a protecting member for the diaphragm 5 is disposed. An outer periphery edge portion of the equalizer 8 is fixed to the dike 94 of the unit case 9. A ceiling surface in a central portion of the equalizer 8 is formed into a dome shape, and a gap is maintained with respect to the center dome 51 of the diaphragm 5. The equalizer 8 has a plurality of holes for conducting the acoustic waves to the diaphragm 5.

To an outer periphery of a lower end portion of the ring yoke 1, an open end portion of a bottomed cylinder 14 is fitted, and the lower end of the ring yoke 1 is closed by the bottomed cylinder 14. The rear air chamber 15, which is relatively large, is formed inside the ring yoke 1 and the bottomed cylinder 14. In the rear air chamber 15, an acoustic resistor 7 is disposed being in intimate contact with a lower surface of the yoke 2. An upper end surface of the acoustic resistor 7 is pressed against the lower surface of the yoke 2. The acoustic resistor 7 is disposed on a back side of the diaphragm 5. A back side space of the diaphragm 5 communicates with the acoustic resistor 7 through the magnetic gap, the second air chamber 10, and the holes 22 of the yoke 2, and further communicates with the air chamber 15.

In the flange 91 of the unit case 9, an appropriate number of holes 93 penetrating through the flange 91 in a thickness direction are formed. The holes 93 connect a back side space of the sub-dome 52 of the diaphragm 5 with an external space. With such a configuration, directivity of the microphone unit is made unidirectional. On an outer periphery surface side of the unit case 9, a microphone case coupling part 92 is formed. A microphone case is fitted into the microphone case coupling part 92 to form a dynamic microphone.

Upon receiving the acoustic waves, the diaphragm 5 vibrates in the longitudinal direction in accordance with changes in the sound pressure thereof, and the voice coil 6 vibrates in the longitudinal direction together with the diaphragm 5. When the voice coil 6 vibrates, the voice coil 6 traverses the magnetic flux passing through the magnetic gap, and the voice coil 6 generates voice signals in accordance with the changes in the sound pressure. Electroacoustic conversion is performed in such a manner, and the voice signals are output to the outside through leads from both ends of the voice coil 6.

Narrowing the magnetic gap is effective to enhance sensitivity of the dynamic microphone unit, and the magnetic gap is narrowed as possible within such a range as the voice coil 6 is not contact with the pole piece 4 and the ring yoke 1. Thus, the voice coil 6 substantially divides the back side space of the diaphragm 5 into the back side space of the center dome 51 and the back side space of the sub-dome 52. Both of the back side spaces communicate with each other through the magnetic gap.

Here, an acoustic capacitance of the back side space of the center dome 51 is denoted by sc, and an acoustic capacitance of the back side space of the sub-dome 52 is denoted by ss. An acoustic mass of the gap produced between an inner periphery surface of the voice coil 6 and an outer periphery surface of the pole piece 4 is denoted by mgi, and an acoustic resistance thereof is denoted by rgi. An acoustic mass of the gap produced between an outer periphery surface of the voice coil 6 and the inner periphery surface of the flange portion 11 of the ring yoke 1 is denoted by mgo, and an acoustic resistance thereof is denoted by rgo. In addition, a sound pressure applied to the diaphragm 5 from the front side thereof is denoted by P1, an acoustic resistance of the acoustic resistor 7 disposed in the air chamber 15 of the unit case 9 is denoted by r1, an acoustic mass of a back side air chamber of the diaphragm 5 is denoted by m0, and an acoustic capacitance thereof is denoted by s0. Furthermore, an acoustic capacitance of the air chamber 10 produced between an inner periphery wall surface of the yoke 2 and an outer periphery surface of the magnet 3 is denoted by sg, the sound pressure applied to the back side of the diaphragm 5 through the holes 93 is denoted by P2, and an acoustic resistance of the holes 93 is denoted by r2. FIG. 7 shows an equivalent circuit of the conventional dynamic microphone unit including these acoustic capacitances, acoustic masses, and acoustic resistances, as elements thereof.

As shown in FIG. 7, the acoustic capacitances sc and ss of the two back side spaces of the diaphragm 5 are connected via the acoustic mass mgi, the acoustic resistance rgi, the acoustic resistance rgo, and the acoustic mass mgo. The acoustic masses mgi and mgo of the inner periphery side and the outer periphery side of the magnetic gap divided by the voice coil 6, and the acoustic capacitances sc and ss of the back side space of the center dome 51 and the back side space of the sub-dome 52 configure a resonance circuit. Resonance of the resonance circuit makes a frequency response characteristic curve uneven.

In addition, the magnetic gap communicates with the second air chamber 10 that is relatively small as compared with the rear air chamber 15. If a capacity of the second air chamber 10 is small, and therefore the acoustic capacitance sg thereof is small, the resonance due to the acoustic capacitance sg hardly occurs. However, the center dome 51 preferably has a diameter as large as possible because an effective area of the diaphragm 5 is an area of the center dome 51. As the diameter of the center dome 51 is made larger, a diameter of the voice coil 6 is made larger. As the diameter of the voice coil 6 is made larger, diameters of the magnetic gap and the second air chamber 10 are made larger, and the capacity of the second air chamber 10 is made larger, which makes the acoustic capacitance sq of the second air chamber 10 large. As the acoustic capacitance sg is made larger, the resonance due to the acoustic capacitance sg is more likely to occur.

If the resonance is likely to occur in such a manner, peaks develop in the audio frequency band, making frequency response characteristics deteriorate. It is preferable for a unidirectional microphone to have a uniform directivity from low frequency bandwidths to high frequency bandwidths. However, the development of the peaks in the frequency response characteristics makes the directivity non-uniform, causing a problem in which a timbre of acoustic waves in a specific direction changes.

The invention described in Japanese Unexamined Patent Application Publication No. 2013-55466 is disclosed as an art related to the conventional dynamic microphone unit described above. The invention described in Japanese Patent Laid-Open No. 2013-55466 allows for making the acoustic capacitance sg small by making the capacity of the second air chamber 10 small in the dynamic microphone unit including the rear air chamber 15 and the second air chamber 10, in the conventional example shown in FIG. 6. In addition, the dynamic microphone unit has a configuration in which a laminar acoustic resistor is disposed to the second air chamber under a tension, and the voice coil is brought into contact with the acoustic resistor within the maximum displacement thereof. This is for reducing impact noise generated when the diaphragm is widely displaced.

SUMMARY OF THE INVENTION

The present invention has an object to provide a dynamic microphone unit and a dynamic microphone that can reduce resonance to reduce peaks developing in frequency response characteristics by contriving a configuration in the vicinity of a magnetic gap communicating with a rear air chamber, so as to achieve uniformity of directivity.

The present invention is a dynamic microphone unit including: a diaphragm vibrating upon receiving acoustic waves; a voice coil fixed to the diaphragm and disposed in a magnetic gap, the voice coil vibrating together with the diaphragm; a magnetic circuit generating a magnetic field in the magnetic gap; and a rear air chamber communicating with a back side space of the diaphragm via the magnetic gap. The most important feature of the present invention is in that there are holes formed in a member forming the magnetic circuit, the holes for connecting the back side space of the diaphragm and the rear air chamber.

The presence of the holes for connecting the back side space of the diaphragm with the rear air chamber, in addition to the magnetic gap, corresponds to a circuit equivalent to that in which an acoustic mass and an acoustic capacitance of the holes are connected in parallel to an acoustic mass and an acoustic capacitance of a space where the voice coil is disposed. The acoustic mass of the portions connecting the back side space of the diaphragm with the rear air chamber is therefore made small, allowing for reduction of the resonance due to the acoustic mass.

DETAILED DESCRIPTION OF THE PREFERRED EMBODIMENTS

Figure 6:
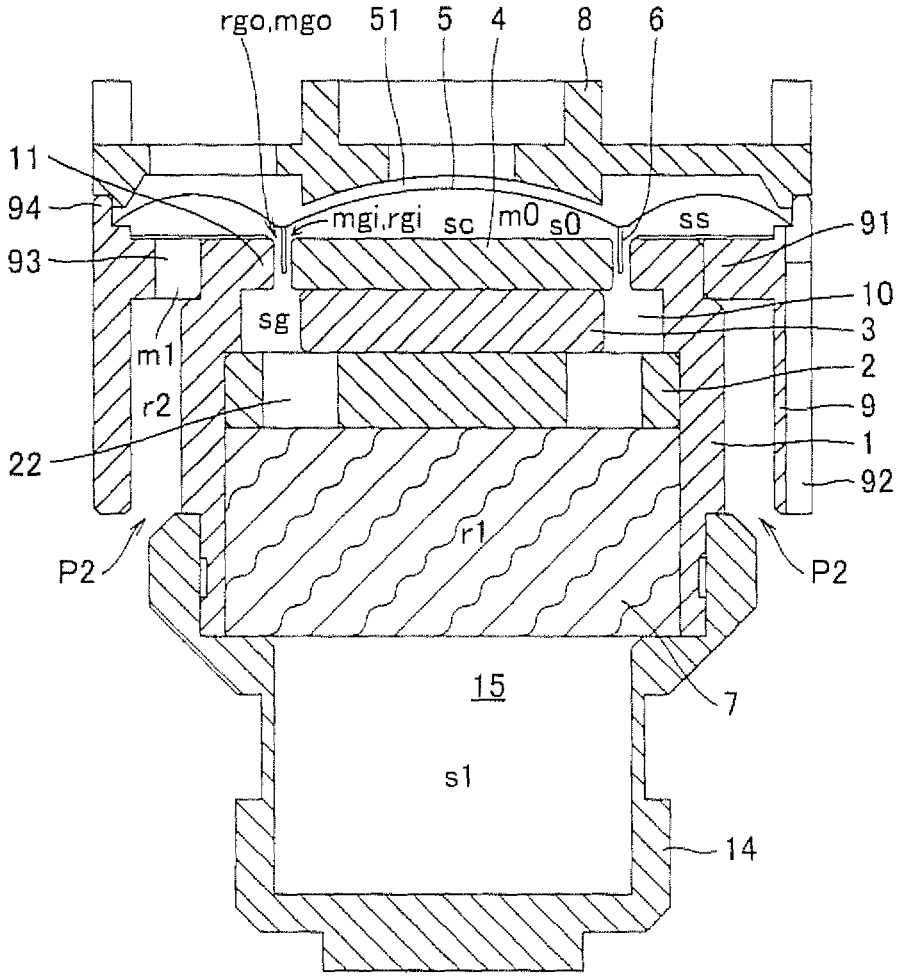
FIG. 6 RELATED ART
FIG. 6 is a longitudinal cross sectional view showing an example of a conventional dynamic microphone unit.

An embodiment of a dynamic microphone unit according to the present invention will be described below with reference to the drawings, and a dynamic microphone according to the present invention will further be described. Note that components identical to those of the conventional dynamic microphone unit shown in FIG. 6 are denoted by the same reference numerals.

EMBODIMENT

Figure 1:
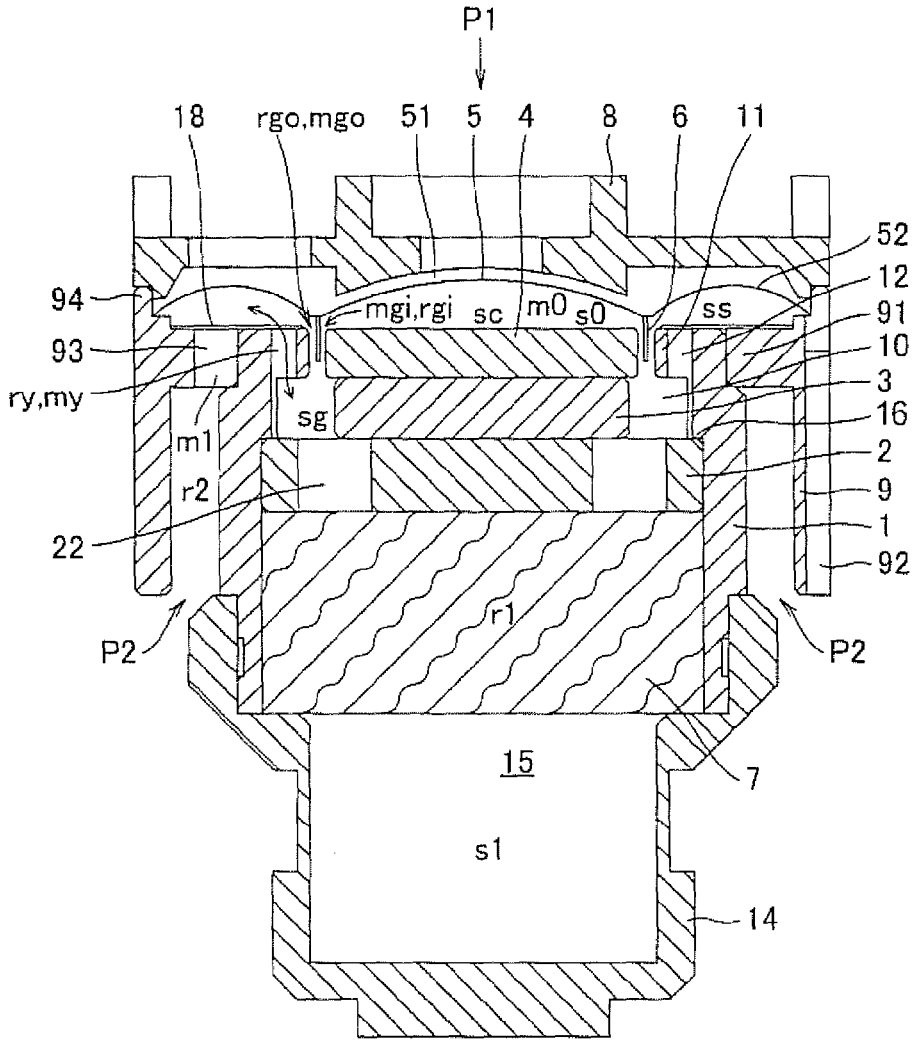
FIG. 1 is a longitudinal cross sectional view showing an embodiment of a dynamic microphone unit according to the present invention.

FIG. 1 shows an embodiment of a unidirectional dynamic microphone unit. In FIG. 1, the dynamic microphone unit includes a unit case 9 as a base, and is configured by installing the following members in the unit case 9.

The unit case 9 is a member having a cylindrical shape and includes a flange portion 91 protruding inward and formed in an inner periphery of an upper end portion thereof, shown in FIG. 1, of the unit case 9. An outer periphery surface of an upper end portion of a cylindrical-shaped ring yoke 1 is fitted and fixed to an inner periphery surface of the flange portion 91 of the unit case 9. The ring yoke 1 is made of a magnetic substance. On an inner periphery side of an upper end portion of the ring yoke 1, a flange portion 11 is formed protruding inward. On an underside of the flange portion 11, a step portion 16 is formed at predetermined intervals over the entire circumference of the inner periphery side of the ring yoke 1, and the ring yoke 1 has an inner diameter that is slightly larger on the underside of the step portion 16.

A disk-shaped yoke 2 inserted from a lower-side open end of the ring yoke 1 is pushed against the step portion 16 of the ring yoke 1, and the yoke 2 is fixed to the ring yoke 1. The inner periphery surface of the ring yoke 1 and the outer periphery surface of the yoke 2 are in intimate contact, and the yoke 2 and the ring yoke 1 are magnetically coupled. The yoke 2 includes a plurality of holes 22 penetrating therethrough in a thickness direction, the holes 22 being formed in a circumferential direction along an outer periphery edge of the yoke 2.

To an upper surface of the yoke 2, a disk-shaped magnet 3 is fixed in such a manner that a central axis thereof is identical to a central axis of the yoke 2. An outer diameter of the magnet 3 is defined such that each of the holes 22 of the yoke 2 is only partially covered by the magnet 3. On an upper surface of the magnet 3, a pole piece 4 that has a disk shape and has an outer diameter slightly larger than that of the magnet 3 is fixed in such a manner that a central axis thereof is identical to the central axis of the magnet 3.

An inner periphery surface of the flange portion 11 of the ring yoke 1 faces an outer periphery surface of the pole piece 4 across a relatively narrow gap. The gap is a cylindrical-shaped magnetic gap. The magnet 3, the yoke 2, the ring yoke 1, the magnetic gap, and the pole piece 4 form a magnetic circuit. Magnetic flux emanating from the magnet 3 passes through the magnetic circuit and returns to the magnet 3. In the magnetic gap, a magnetic field is uniformly generated in a circumferential direction.

An outer diameter of the magnet 3 is smaller than a diameter of the inner periphery surface of the ring yoke 1 that an outer periphery surface of the magnet 3 faces, and an air chamber 10 is produced between the outer periphery surface of the magnet 3 and the inner periphery surface of the ring yoke 1. The air chamber 10 communicates with a rear air chamber 15 to be described hereafter via the holes 22 of the yoke 2, to form part of the rear air chamber. In the present specification, the air chamber 10 is called a second air chamber after the rear air chamber 15.

An outer periphery edge of an upper end of the unit case 9 is formed into a dike 94 having a cylindrical shape erected upward. To an inner periphery side of the dike 94, an outer periphery edge portion of a diaphragm 5 is fixed with an adhesive. The diaphragm 5 is a molded component made of a synthetic resin or a metal film, and includes a center dome 51 and a sub-dome 52 that surrounds the center dome 51. The center dome 51 has a shape obtained by cutting out part of a spherical surface. In contrast, the sub-dome 52 has a partial-arc-shaped cross section, and is successively formed from an outer periphery edge of the center dome 51 to surround the outer periphery of the center dome 51. An outer periphery edge portion of the sub-dome 52 is fixed to the unit case 9. Upon receiving acoustic waves, the diaphragm 5 can vibrate in a longitudinal direction (vertical direction in FIG. 1) according to sound pressure thereof, using the outer periphery edge portion of the sub-dome 52 as a fulcrum because the outer periphery edge portion of the sub-dome 52 is fixed to the unit case 9 as described above.

To the diaphragm 5, a voice coil 6 is fixed along a circular boundary line between the center dome 51 and the sub-dome 52. The voice coil 6 is formed into a cylindrical shape by winding a thin conductive wire and is further hardened, and one end of the cylindrical shape is fixed to the diaphragm 5. The voice coil 6 is positioned in the magnetic gap in the state where the outer periphery edge portion of the sub-dome 52 of the diaphragm 5 is fixed to the unit case 9. The voice coil 6 is separated from both of the ring yoke 1 and the pole piece 4.

On a front side of the diaphragm 5, an equalizer 8 which also serves as a protecting member for the diaphragm 5 is disposed, with an outer periphery edge portion thereof fixed to the dike 94 of the unit case 9. A ceiling surface in a central portion of the equalizer 8 is formed into a dome shape, and a gap is maintained with respect to the center dome 51 of the diaphragm 5 at a certain interval. The equalizer 8 has a plurality of holes for conducting the acoustic waves from the outside to the diaphragm 5.

To an outer periphery of a lower end portion of the ring yoke 1, an open end portion of a bottomed cylinder 14 is fitted and fixed, and the lower end of the ring yoke 1 is closed by the bottomed cylinder 14. The ring yoke 1 and the bottomed cylinder 14 form inside thereof the rear air chamber 15, which is relatively large. The rear air chamber 15 is formed behind the magnetic circuit (below the magnetic circuit in FIG. 1) formed by the magnet 3, the yoke 2, the ring yoke 1, the magnetic gap, and the pole piece 4.

In the rear air chamber 15, an acoustic resistor 7 is disposed being in intimate contact with a lower surface of the yoke 2. The acoustic resistor 7 is formed by stacking nonwoven fabrics or the like thick, which accounts for half capacity of the rear air chamber 15. An outer periphery edge portion of a lower end of the acoustic resistor 7 is supported by a step portion formed in an inner periphery of the bottomed cylinder 14, and an upper end surface of the acoustic resistor 7 is pressed against the lower surface of the yoke 2. The acoustic resistor 7 is on the back side of the diaphragm 5. A back side space of the diaphragm 5 communicates with the acoustic resistor 7 via the magnetic gap, the second air chamber 10, and the holes 22 of the yoke 2, and further communicates with the air chamber 15.

In the flange 91 of the unit case 9, an appropriate number of holes 93 penetrating through the flange 91 in a thickness direction are formed. The holes 93 communicate with a rear acoustic terminal that connects the back side space of the sub-dome 52 of the diaphragm 5 with the external space. With such a configuration, directivity of the microphone unit is made unidirectional. On an outer periphery surface side of the unit case 9, a microphone case coupling part 92 is formed. To form a dynamic microphone using the dynamic microphone unit, a microphone case is fitted into the microphone case coupling part 92.

Upon receiving the acoustic waves, the diaphragm 5 vibrates in the longitudinal direction in accordance with changes in the sound pressure thereof, and the voice coil 6 vibrates in the longitudinal direction together with the diaphragm 5. When the voice coil 6 vibrates, the voice coil 6 traverses the magnetic flux passing through the magnetic gap, and the voice coil 6 generates voice signals in accordance with the changes in the sound pressure. Electroacoustic conversion is performed in such a manner, and the voice signals are output to the outside through leads from both ends of the voice coil 6. The leads from both the ends of the voice coil 6 are routed, for example, along a back surface of the sub-dome 52.

As with the conventional example described above, an acoustic capacitance of the back side space of the center dome 51 of the diaphragm 5 is denoted by sc, and an acoustic capacitance of the back side space of the sub-dome 52 is denoted by ss. An acoustic mass of the gap produced between an inner periphery surface of the voice coil 6 and an outer periphery surface of the pole piece 4 is denoted by mgi, and an acoustic resistance thereof is denoted by rgi. An acoustic mass of the gap produced between an outer periphery surface of the voice coil 6 and an inner periphery surface of the flange portion 11 of the ring yoke 1 is denoted by mgo, and an acoustic resistance thereof is denoted by rgo. In addition, a sound pressure applied to the diaphragm 5 from a front side thereof is denoted by P1, an acoustic resistance of the acoustic resistor 7 disposed in the air chamber 15 of the unit case 9 is denoted by r1, an acoustic mass of a back side air chamber of the diaphragm 5 is denoted by m0, and an acoustic capacitance thereof is denoted by s0. Furthermore, an acoustic capacitance of the air chamber 10 produced between an inner periphery wall surface of the yoke 2 and an outer periphery surface of the magnet 3 is denoted by sg, a sound pressure applied to the back side of the diaphragm 5 from the rear acoustic terminal through the holes 93 is denoted by P2, and an acoustic resistance of the holes 93 is denoted by r2.

Figure 7:
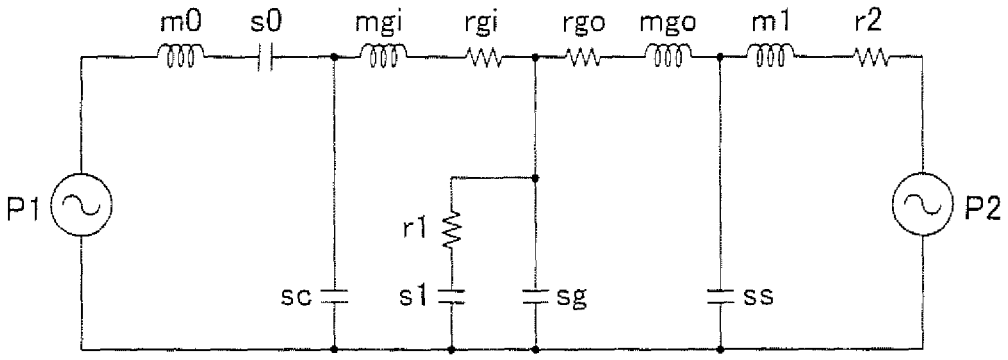
FIG. 7 RELATED ART
FIG. 7 an acoustically equivalent circuit diagram of the conventional example.

The configuration of the dynamic microphone unit that has been described up to now is identical to that of the conventional dynamic microphone unit described with reference to FIG. 6, and an acoustically equivalent circuit thereof is also identical to the conventional equivalent circuit shown in FIG. 7. Hence, if the configuration is left unchanged, the acoustic mass mgo and the acoustic resistance rgo are likely to resonate with the acoustic capacitance ss of the back side space of the diaphragm 5, causing peaks to develop in frequency response characteristics, and it is not possible to make the directivity uniform.

Thus, in the embodiment shown in FIG. 1, in the flange portion 11 of the ring yoke 1 being one of the members forming the magnetic circuit, an appropriate number of holes 12 penetrating the flange portion 11 in a vertical direction are formed. The holes 12 therefore communicate with the back side space of the diaphragm 5, as well as with the second air chamber 10. Although the magnetic gap is provided as a space connecting the back side space of the diaphragm 5 and the rear air chamber 15, the holes 12 also connect the back side space of the diaphragm 5 with the rear air chamber 15. In other words, the holes 12 for connecting the back side space of the diaphragm 5 with the rear air chamber 15 are formed in the ring yoke 1, in addition to the magnetic gap.

Figure 3:
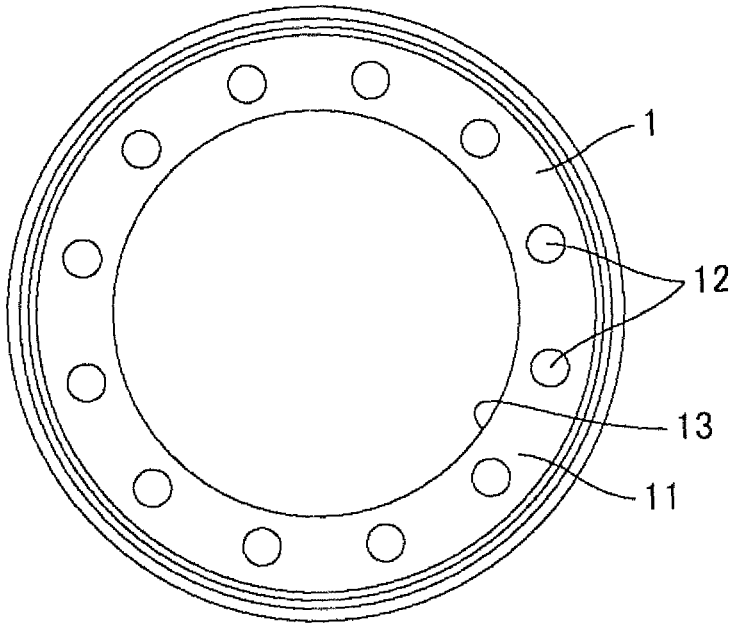
FIG. 3 is a front view of a ring yoke in the embodiment.

The holes 12 are formed, as shown in FIG. 3, at positions deviated outward in a radial direction from an inner periphery surface 13 of the flange portion 11 of the ring yoke 1, and are designed such that portions of the inner periphery surface 13 of the flange portion 11 are not cut off by the holes 12. It is thereby possible to avoid weakening the magnetic field generated in the magnetic gap.

Figure 2:
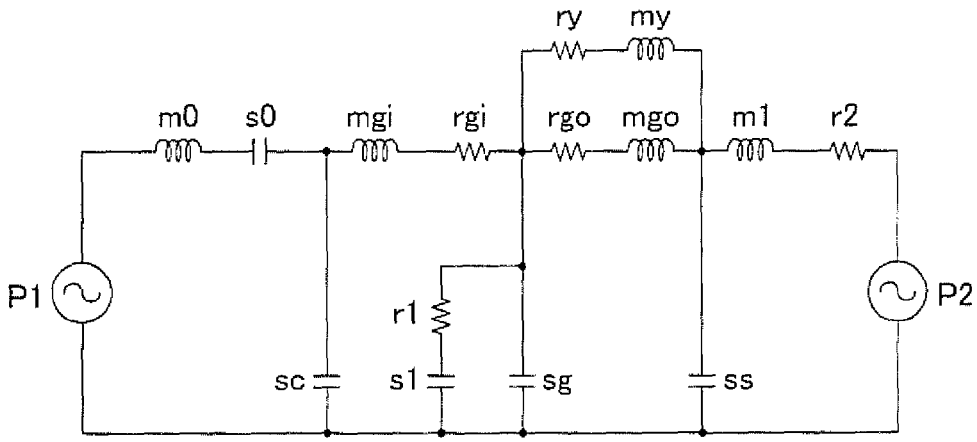
FIG. 2 is an acoustically equivalent circuit diagram of the embodiment.

FIG. 2 shows an acoustically equivalent circuit of the embodiment of the dynamic microphone unit to which the holes 12 for connecting the back side space of the diaphragm 5 with the rear air chamber 15 are added. The equivalent circuit shown in FIG. 2 will be compared with the conventional example of the equivalent circuit shown in FIG. 7. The series connection of the acoustic mass mgo and the acoustic resistance rgo of the gap (magnetic gap) produced between the outer periphery surface of the voice coil 6 and the inner periphery surface of the flange portion 11 of the ring yoke 1 is connected in parallel to a series connection of an acoustic mass my and an acoustic resistance ry of the holes 12. The addition of the acoustic mass my and the acoustic resistance ry makes difference from the conventional dynamic microphone unit.

By Adding the series connection of the acoustic mass my and the acoustic resistance ry to the series connection of the acoustic mass mgo and the acoustic resistance rgo of the outer periphery side of the magnetic gap in parallel, the acoustic mass of the communicating space from the back side space of the diaphragm 5 to the second air chamber 10 is made small. A small acoustic mass of this part hardly causes resonance with the acoustic capacitance sg of the second air chamber 10 and the acoustic capacitance ss of the back side space of the sub-dome 52 of the diaphragm 5.

When the outer diameter of the center dome 51 of the diaphragm 5 is made large to enhance sensitivity of the microphone, the capacity of the second air chamber 10 is made large, making the acoustic capacitance sg thereof large. But even if the acoustic capacitance sg is made large, the resonance is still hard to occur due to the formation of the holes 12 as described above. Thus, the peaks developing in the frequency response characteristics are reduced, which allows a dynamic microphone unit of preferable directivity to be obtained.

Figure 4:
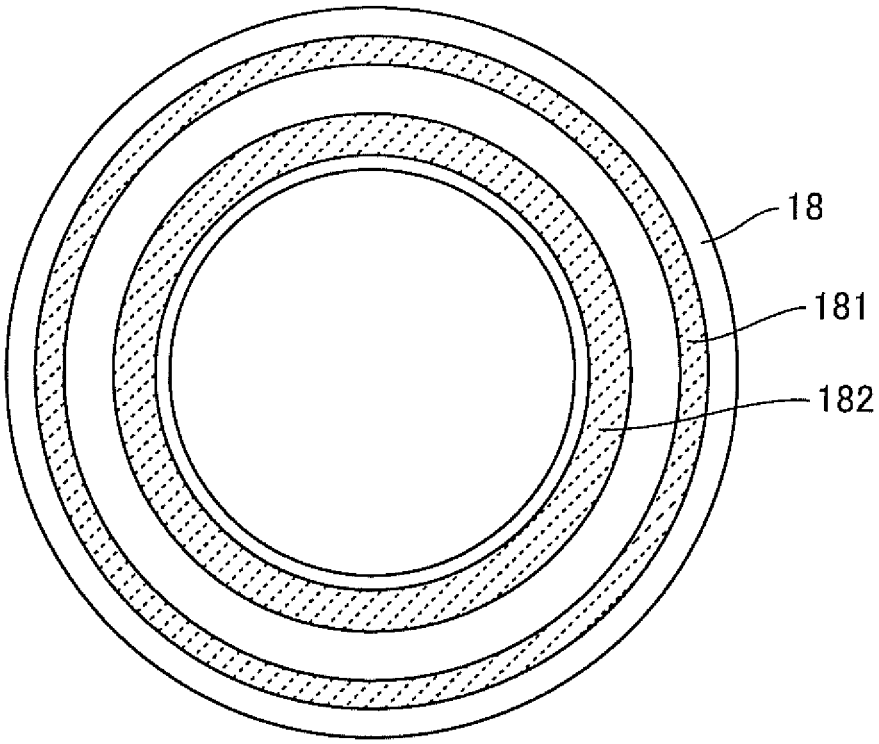
FIG. 4 is a front view showing an example of an acoustic resistance plate that can be added to the embodiment.

To further enhance the effect brought by the present invention, in the embodiment shown in FIG. 1, an acoustic resistance plate 18 for covering the holes 12 is added. The acoustic resistance plate 18 is formed by etching a laminar material. The acoustic resistance plate 18 includes innumerable minute holes in a portion that covers the holes 12 formed in the ring yoke 1 forming the magnetic circuit. FIG. 4 shows a configuration of the acoustic resistance plate 18 in detail. As shown in FIG. 4, the acoustic resistance plate 18 is a torus-shaped member obtained by pressing a disk-shaped thin plate to form a center hole, and includes two acoustic resistance areas 181 and 182 that are formed into concentric circular strips on an outer periphery side and an inner periphery side thereof.

An upper end surface of the flange portion 91 of the unit case 9 is flush with un upper end surface including the flange portion 11 of the ring yoke 1, and the acoustic resistance plate 18 is stuck covering the upper end surfaces of these unit case 9 and ring yoke 1. An outer diameter of the acoustic resistance plate 18 is set in conformity with a maximum diameter of the sticking face of the acoustic resistance plate 18 of the unit case 9. The inner diameter of the acoustic resistance plate 18 is set such that the acoustic resistance plate 18 can cover the holes 12 of the ring yoke 1, and is set so as to be equal to or slightly smaller than an inner diameter of the flange portion 11 of the ring yoke 1. The acoustic resistance area 181 of the acoustic resistance plate 18 is formed at a position at which the acoustic resistance plate 18 can cover the holes 93 formed in the unit case 9. The acoustic resistance area 182 of the acoustic resistance plate 18 is formed at a position at which the acoustic resistance plate 18 can cover the holes 12 formed in the flange portion 11 of the ring yoke 1.

Although methods for producing the acoustic resistance plate 18 are optional, the acoustic resistance plate 18 shown in FIG. 4 is produced by etching a torus-shaped thin plate. The circular strip-shaped acoustic resistance areas 181 and 182 are formed by etching and opening innumerable minute holes. The acoustic resistance plate 18 is stuck on, as shown in FIG. 1, the upper end surfaces of the unit case 9 and the ring yoke 1, which are flush with each other. The holes 93 formed in the unit case 9 are covered with the acoustic resistance area 181, and the holes 12 formed in the ring yoke 1 are covered with the acoustic resistance area 182. In such a manner, the acoustic resistance plate 18 of a single plate that is formed by etching a single plate-like material covers the holes 93 and 12 formed in the unit case 9 and the ring yoke 1 that form the magnetic circuit.

The acoustic mass mgo of the gap between a surface on the outer periphery side of the voice coil 6 and the inner periphery surface of the flange portion 11 of the ring yoke 1 deeply depends on a size of the gap. In particular, dimensional precision of the voice coil 6 is likely to vary from one production lot to another, causing variations in the acoustic mass mgo. The variations in the acoustic mass mgo can be reduced by adding the acoustic resistance plate 18 and covering the holes 12 of the ring yoke 1 with the acoustic resistance area 182 of the acoustic resistance plate 18.

The acoustic resistance plate 18 also covers the holes 93 of the unit case 9 communicating with the rear acoustic terminal, with the acoustic resistance area 181. Since an acoustic resistance value of the acoustic resistance area 181 that is added to an acoustic resistance r2 of the holes 93 of the unit case 9 is stable, the acoustic resistance r2 is made stable.

The acoustic resistance values of the acoustic resistance areas 181 and 182 of the acoustic resistance plate 18 produced by etching are reliably fixed according to producing condition setting in producing, and the variations between individual plates are small. As a result, the acoustic resistance r2 of the rear acoustic terminal shown in FIG. 2 and the acoustic resistance ry of the holes 12 added to the ring yoke 1 are reliably fixed, which allows a dynamic microphone unit having frequency response characteristics containing few peaks from high frequencies to low frequencies to be obtained.

Figure 5:
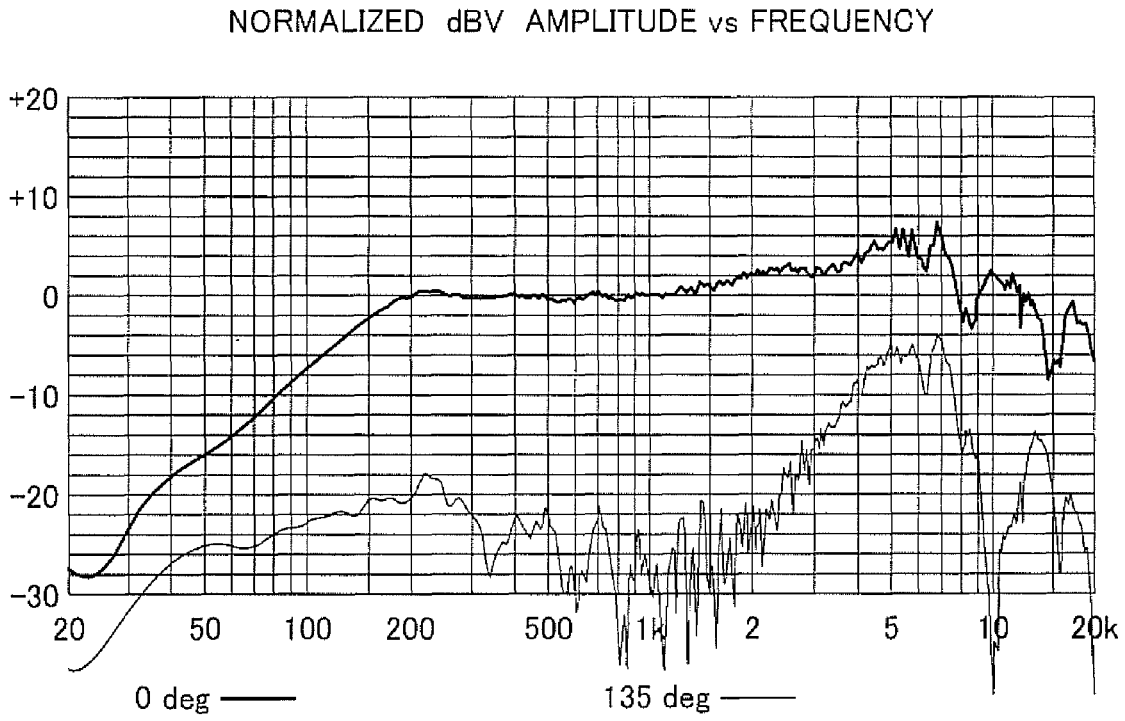
FIG. 5 is a graph showing frequency response characteristics of the embodiment.

FIG. 5 shows frequency response characteristics of the dynamic microphone unit according to the embodiment, and the frequency response characteristics contain few peaks from high frequencies to low frequencies.

The acoustic resistance values per unit area of the acoustic resistance areas 181 and 182 of the acoustic resistance plate 18 may be the same, or may be made different from each other according to design specifications of the microphone unit. In addition, the entire surface of the acoustic resistance plate 18 may be made into the acoustic resistance area.

With respect to units such as microphone units used for wireless microphones whose air chambers are narrow, variations in the acoustic resistance are large, and the frequency response characteristics thereof are likely to vary. However, by employing the technical concept of the present invention, the variations in the frequency response characteristics can be reduced even in a microphone unit whose air chamber is narrow.

By installing the dynamic microphone unit described above to a microphone case, it is possible to obtain a dynamic microphone that can show the effect having been described. The microphone case is installed with appropriate components such as a connector such that the functions as a microphone are fulfilled.

What is claimed is:

1. A dynamic microphone unit comprising:

a diaphragm vibrating upon receiving acoustic waves;

a voice coil fixed to the diaphragm and disposed in a magnetic gap, the voice coil vibrating together with the diaphragm;

a magnetic circuit generating a magnetic field in the magnetic gap; and a rear air chamber communicating with a back side space of the diaphragm via the magnetic gap, wherein a member forming the magnetic circuit includes holes formed therein for connecting the back side space of the diaphragm with the rear air chamber, and wherein the magnetic circuit is formed by a magnet, a yoke and a pole piece that are fixed across the magnet, and a ring yoke to which the yoke is fixed and whose inner periphery surface faces an outer periphery surface of the pole piece to form the magnetic gap together with the pole piece.

2. The dynamic microphone unit according to claim 1, wherein the magnetic gap is formed between the outer periphery surface of the pole piece and the inner periphery surface of the ring yoke, and the holes for connecting the back side space of the diaphragm with the rear air chamber are formed in the ring yoke.

3. The dynamic microphone unit according to claim 1, wherein the holes for connecting the back side space of the diaphragm with the rear air chamber are formed in a flange portion, which protrudes inward, of the ring yoke at positions deviated outward in a radial direction from an inner periphery surface of the flange portion.

4. The dynamic microphone unit according to claim 1, wherein a second air chamber communicating with the rear air chamber is formed between an outer periphery surface of the magnet and the inner periphery surface of the ring yoke, and the holes for connecting the back side space of the diaphragm with the rear air chamber communicate with the second air chamber.

5. The dynamic microphone unit according to claim 1, wherein the holes for connecting the back side space of the diaphragm and the rear air chamber are covered with an acoustic resistance plate.

6. The dynamic microphone unit according to claim 5, wherein the acoustic resistance plate includes innumerable minute holes in a portion where the acoustic resistance plate covers the holes for connecting the back side space of the diaphragm with the rear air chamber.

7. The dynamic microphone unit according to claim 5, wherein the acoustic resistance plate is formed by etching a plate-like material.

8. The dynamic microphone unit according to claim 1, wherein a unit case is fixed to an outer periphery of the member forming the magnetic circuit, an outer periphery of the diaphragm is fixed to the unit case, and holes for connecting the back side space of the diaphragm with an external space are formed in the unit case.

9. The dynamic microphone unit according to claim 8, wherein the holes formed in the unit case are covered with an acoustic resistance plate.

10. The dynamic microphone unit according to claim 9, wherein the acoustic resistance plate for covering the holes formed in the unit case is formed, together with an acoustic resistance plate for covering the holes that connect the back side space of the diaphragm with the rear air chamber, by etching a single plate-like material.

11. A dynamic microphone configured by installing a dynamic microphone unit in a microphone case, wherein the dynamic microphone unit is the dynamic microphone unit according to claim 1.

* * * * *